United States Patent [19]

McCarthy

[11] 4,372,864

[45] Feb. 8, 1983

[54] REAGENT FOR FROTH FLOTATION OF BITUMINOUS COAL

[76] Inventor: James R. McCarthy, 623 Nevin Ave., Sewickley, Pa. 15143

[21] Appl. No.: 860,899

[22] Filed: Dec. 15, 1977

[51] Int. Cl.[3] ..... B03D 1/00

[52] U.S. Cl. ..... 252/61; 209/49; 209/166; 210/705

[58] Field of Search ..... 209/166, 167, 49; 252/188, 33.6, 32.76, 61

[56] References Cited

U.S. PATENT DOCUMENTS

| | | | |
|---|---|---|---|
| 1,420,164 | 6/1922 | Trent | 209/49 |
| 1,425,185 | 8/1922 | Ellis | 209/166 |
| 1,425,587 | 8/1922 | Ellis | 209/166 |
| 1,483,270 | 2/1924 | Barrows | 209/166 |
| 1,497,699 | 6/1924 | Sayre | 209/166 |
| 1,552,197 | 9/1925 | Bates | 209/166 |
| 1,573,226 | 2/1926 | Crousdale | 209/166 |
| 1,593,232 | 7/1926 | Whitworth | 209/166 |
| 1,628,046 | 5/1927 | Norman | 209/166 |
| 1,652,060 | 12/1927 | Smith | 209/167 |
| 1,667,277 | 4/1928 | Wilkinson | 209/166 |
| 1,772,386 | 8/1930 | Derby | 209/166 X |
| 1,788,331 | 1/1931 | Schafer | 209/167 |
| 1,788,332 | 1/1931 | Schafer | 209/167 |
| 1,810,658 | 6/1931 | Kritchevsky | 252/188 X |
| 2,088,624 | 8/1937 | Tschudy | 209/167 X |
| 2,265,851 | 12/1941 | Matheson | 252/33.6 X |
| 2,492,936 | 12/1949 | Nokes | 209/167 |
| 2,797,238 | 6/1957 | Miller | 252/32.7 E |
| 2,959,544 | 11/1960 | Smith | 252/32.76 |
| 2,999,813 | 9/1961 | Givens | 252/33.6 |
| 3,536,445 | 10/1970 | Hansley | 252/188 X |
| 3,919,080 | 11/1975 | Stautor | 209/167 |
| 4,118,331 | 10/1978 | Jahnke | 252/32.7 E |

FOREIGN PATENT DOCUMENTS

| | | | |
|---|---|---|---|
| 491289 | 5/1928 | Fed. Rep. of Germany | 209/167 |
| 378063 | 7/1932 | United Kingdom | 209/167 |

*Primary Examiner*—Norman Yudkoff

*Attorney, Agent, or Firm*—Buell, Blenko, Ziesenheim & Beck

[57] ABSTRACT

A reagent and a method for using the reagent for treating a solid material disposed in a liquid medium and having an oxygen-controlled surface condition. The reagent includes a liquid hydrocarbon, a reducing material and an activator material. The liquid hydrocarbon such as mineral oil has a specific gravity different from the specific gravity of the liquid medium. The reducing material such as phosphorous pentasulfide is present in an amount sufficient to establish a reducing environment around the solid material for breaking the oxygen control on the surface of the solid material. The activator material such as zinc thiophosphate is present in an amount sufficient to establish an electrostatic charge on the solid material after the oxygen-controlled surface condition has been broken. A more specific feature of the invention is directed to the method of flotation of extremely fine bituminous coal having an oxygen-controlled surface condition. The reagent is used in the conventional froth flotation equipment of the prior art.

4 Claims, No Drawings

REAGENT FOR FROTH FLOTATION OF BITUMINOUS COAL

BACKGROUND OF THE INVENTION

This invention relates to the recovery of bituminous coal in conventional froth flotation equipment. More particularly, the invention is directed to a reagent for treating a solid material disposed in a liquid medium and having an oxygen-controlled surface condition.

Bituminous coal is a porous material in which environmental gases, such as air, may be entrapped. There are volatile surface products in the coal which unite with oxygen on the surface of a coal particle. There is inorganic material generally referred to in the industry as ash content and includes oxides, carbonates and silicates. All of these factors contribute to the basic problem of an oxygen-controlled surface condition being present on particulate bituminous coal. It is well known in the coal flotation industry, that coal having an oxygen-controlled surface condition will not be wetted by liquid hydrocarbons which are normally used in coal flotation. Consequently, large amounts of coal have not been recovered but have been carried into the refuse ponds and piles wherever there has been a coal production facility.

Froth flotation processes and equipment have been used for many years in the coal recovery industry. Much agitation, both mechanically and through the use of bubbling air, is used to effect the desired flotation. In other words, the environment within which the coal is being treated for flotation is also filled with oxygen. Thus, the environment within the froth flotation process contributes significantly to the maintaining of the oxygen-controlled surface condition on the bituminous coal fines.

The bituminous coal also includes pyritic sulfur and organic sulfur. The presence of a high sulfur content in the coal causes it to become a low grade material which may cause unwanted sulfur compounds being released into the atmosphere when the coal is burned. Further, the coal cannot be used with such high sulfur contents for applications such as Sea-coal which is a high grade metallurgical coal. The presence of the sulfur in the coal effects the formation of sulfuric acid when the coal is mixed with water. The longer the coal stands in the water, the more acid the water becomes. The acid water effluent is difficult to dispose of. It is a particular problem where such an effluent is being dumped into water tributaries and streams.

Over the years, large deposits of unrecovered coal, flowing from froth flotation processes, has been collected in huge refuse ponds. These ponds may be totally below ground or have been collected in containers above ground. Literally, millions of tons of coal having an oxygen-controlled surface condition lies in these ponds. Vast amounts of the unrecovered bituminous coal is also collected in large piles subjected to the open atmosphere. This is a very basic disadvantage and significant problem associated with the use of the froth flotation equipment which incorporates the use of known flotation reagents.

U.S. Pat. No. 1,667,277 discloses a typical prior art froth flotation process using various types of reagents. Such a prior art operation is maintained in the presence of high oxygen environmental conditions. Chemically, the reagents used in this prior art process as well as other known processes incorporate the use of combined oxygen. Mechanically, the bubbling of air aggravates the oxygen-controlled surface condition on the bituminous coal fines.

Much of the raw bituminous coal sources presently providing a supply to existing froth flotation facilities, contains large amounts of oxidized coal. As noted above, the froth flotation equipment and the existing reagents used in this equipment, are not capable of recovering this oxidized coal. Consequently, large amounts of coal are not recovered. Furthermore, because of the lack of sufficient coal from existing sources, froth flotation equipment is not being used to its fullest extent. The attendant disadvantages to this type of situation is deemed obvious.

PURPOSE OF THE INVENTION

The primary object of this invention is to provide a novel reagent for floating oxidized coal in existing froth flotation equipment.

Another object of this invention is to provide a reagent for effecting the flotation of bituminous coal disposed in water.

A still further object of this invention is to provide a process for treating a mixture of different solid materials in a liquid body wherein one of the solid materials has an oxygen-controlled surface condition.

SUMMARY OF THE INVENTION

The reagent of the invention as described herein comprises a liquid hydrocarbon, a reducing material and an activator material. The liquid hydrocarbon has a specific gravity different from the specific gravity of the liquid medium in which solid material is disposed. The reducing material is present in an amount sufficient to establish a reducing environment around the solid material for eliminating the oxygen-controlled surface condition thereon. The activator material is present in an amount sufficient to establish an electrostatic charge on the solid material after the oxygen-controlled surface condition has been eliminated. More specifically, such a reagent is used to treat bituminous coal disposed in water and having an oxygen-controlled surface condition thereon. Such a bituminous coal material is normally not wettable by a liquid hydrocarbon, and thus cannot be recovered in existing flotation methods. The reagent, as disclosed herein, is used in existing froth flotation equipment which includes the use of agitating equipment and mechanisms for producing air bubbles within the electrolyte.

A further feature of this invention is directed to the process of treating particulate bituminous coal by introducing a supply of hydrogen sulfide into the liquid medium in which the coal is disposed. It is theorized that the action of the hydrogen sulfide in the liquid medium will result in a hydrogen ion and a sulfide ion being formed for acting upon the oxygen and sulfur content of the bituminous coal. The oxygen control of the surface is broken. It has been found that the use of the reagents of this invention also reduces the amount of sulfur in the bituminous coal being recovered. The liquid hydrocarbon in the liquid medium wets the particulate coal after the oxygen control has been eliminated thereby causing it to float on top of the liquid medium.

A reagent useful in effecting the process of introducing the hydrogen sulfide includes a phosphorous pentasulfide, carbon disulfide, zinc ethylenebis(dithiocarbamate) and a liquid hydrocarbon having a paraffinic base.

The phosphorous pentasulfide is present in amounts sufficient to establish a reducing environment around the coal disposed in the liquid medium. The carbon disulfide is an intermediate solvent for dissolving the phosphorous pentasulfide and the zinc ethylenebis(dithiocarbamate). A zinc cation is provided when the zinc ethylenebis(dithiocarbamate) is dissolved in the carbon disulfide. The liquid hydrocarbon is present in an amount sufficient to contain the zinc cation and wet the liberated bituminous coal fines. The carbon disulfide is present in an amount sufficient to contain the phosphorous pentasulfide and zinc ethylenebis(dithiocarbamate) in solution.

A further feature of the invention is directed to the particulate process of forming the bituminous coal reagent being used to recover the bituminous coal fines.

The above features of the invention are based on the discovery that the bituminous coal fines may be wetted in a liquid hydrocarbon after a reducing environment has been established therearound. The reagent of the present invention effects ionization in the electrolyte for eliminating the oxygen on the surface of the bituminous coal. The liquid hydrocarbon in the reagent carries a cation with it when the bituminous coal fines are liberated from the oxygen. The presence of the cation places a strong positive charge on the coal wetted with the liquid hydrocarbon. The tailings in the electrolyte are known to carry a positive charge as suggested in the U.S. Pat. No. 1,425,187. Thus, there is a repulsion that exists between the wetted coal particles having the cation associated therewith and the tailings.

It has been determined that specific chemical compounds will operate to effect the desired results; namely, the eliminating of the oxygen control on the surface of the bituminous coal and the placing of a positive electrochemical charge thereon. Thus, coal will be driven in and on top of the liquid hydrocarbon existing on the top of the water which is the liquid medium for the electrolyte. The use of the disclosed reagent is effective to float bituminous coal particles having a size and a range of about 28 mesh to 425 mesh. In other words, it is anticipated that the reagents of this invention are capable of recovering all of the bituminous coal present in the mixture.

A theoretical explanation of the reactions taking place is offered without being limited to it. It is believed that the hydrogen ion formed in the electrolyte of the froth flotation cell will combine with the oxygen on the oxygen controlled surface of the bituminous coal to form water. It is further believed that the sulfur ion formed in the electrolyte will combine with sulfur in the bituminous coal to form elemental sulfur which will precipitate out.

It has been found that the inclusion of zinc dithiophosphate in the reagent added to the froth flotation equipment will provide the necessary zinc cation, hydrogen ion and the sulfur ion to accomplish the desired results described herein. The zinc thiophosphate compounds may be formed when ethylenebis(dithiocarbamate) is added to the mixture containing phosphorous pentasulfide. It has also been found that a known recognized lubricant additive, including a mixture of zinc dithiophosphate and mineral oil having a paraffinic base, may be used successfully to float oxidized coal in a froth flotation cell. This particular material may be obtained from the Lubrizol Corporation of Cleveland, Ohio, with the designation of Lubrizol 5110.

A further feature of the invention is the use of a liquid hydrocarbon that is free of any oxygenated compounds in combination with zinc dithiophosphate as a froth flotation reagent. Generally, the amount of reagent used in this reagent is 1–10 parts per million of material being treated.

It is recognized that in most prior art froth flotation systems, the material being treated includes 10% solids and 90% liquids. With the use of the reagent made in accordance with this invention, material being treated may include up to 50% solids and 50% liquids. That is, the ratio of solids to water has been reduced from 1:9 to 1:1 thereby effecting a savings in water resources.

The reagent is composed of concentrate and a liquid hydrocarbon. The concentrate includes reducing material and activating material. The liquid hydrocarbon has a specific gravity different from the specific gravity of the liquid medium in which the solid material is to be floated. With respect to the reagent used in combination with the froth flotation equipment, the reducing material is in the phosphorous pentasulfide and the activator material is contained in the zinc ethylenebis(dithiocarbamate). The concentrate composed of these materials is in a specific ratio with respect to the liquid hydrocarbon ranging from about 1:3 to 1:1.

These materials are blended in a very specific fashion which is deemed to be new and patentable. A supply of carbon disulfide is provided as an intermediate solvent material. The intermediate solvent is maintained at a temperature sufficient to provide suitable blending conditions for the phosphorous pentasulfide and zinc ethylenebis(dithiocarbamate). This temperature range may be from about 70° F. to 80° F. The solid materials of phosphorous pentasulfide and zinc ethylenebis(dithiocarbamate) are completely dissolved in the carbon disulfide intermediate solvent material to form a resultant concentrate. Subsequently, the concentrate is then mixed with the liquid hydrocarbon in the noted relative ratio range.

More specifically, with respect to the process of treating a mixture of different solid materials in a liquid body, a reagent made in accordance with this invention is introduced into the liquid in an amount sufficient to form a film or liquid hydrocarbon on top of the liquid body. It is presumed that one of the solid materials in the liquid body has an oxygen-controlled surface condition. In a specific example, bituminous coal having an oxygen-controlled surface condition, is mixed with tailings within a body of water. The reagent includes a reducing material that is present in an amount sufficient to establish a reducing environment around the solid material for breaking the oxygen control thereon. The reagent also includes an activator material that is present in an amount sufficient to establish a positive electrostatic charge on the coal after the oxygen-controlled surface condition has been eliminated. The reagent includes a cation which produces a charge on the coal when it is wetted by the liquid hydrocarbon. Thus, there is an electrostatic repulsion between the treated bituminous coal fines and the tailings bearing a similar positive charge thereon.

The invention will be described in the following specific examples which set forth the preparation of typical reagents and their use in the process of the invention.

EXAMPLE I

The following composition of a reagent was used in a standard froth flotation system.

| Chemical Constituent | Amounts (Parts by Volume) |
|---|---|
| Carbon disulfide | 50 parts |
| Zinc ethylenebis(dithiocarbamate) | 25 parts |
| Phosphorous pentasulfide | 25 parts |

The zinc ethylenebis(dithiocarbamate) and phosphorous pentasulfide were dissolved in the carbon disulfide to form the reagent concentrate. The zinc ethylenebis(-dithiocarbamate) is commercially available as Zineb from DuPont. One part of the reagent concentrate was then mixed with three parts of mineral oil having a paraffinic base.

The resultant reagent was then substituted for the existing reagent being used in an operational froth flotation system. The reagent was added to the system within the range of 1 to 10 parts per million of reagent to mixture being treated. Bituminous coal particles were recovered on the top of the liquid body in the range of from 7.5 to 10 tons of coal for each gallon of reagent being used.

EXAMPLE II

A standard, commercially available mixture of zinc dithiophosphate in oil having a paraffinic base was used in a production facility incorporating well known froth flotation equipment. This particular material is commercially known as Lubrizol 5110. About 1 pound of Lubrizol 5110 was used for each ton of run-of-the-mine feed or solids which is mixed in water. The ratio of parts of water to parts of feed or solids is 9:1.

This material has been used in froth flotation equipment wherein oxidized coal has been present in the source material from which the coal is to be recovered. It has been determined that through the action of the reagent within the froth flotation cells that this oxidized coal has been liberated from the oxygen and the resultant unbound coal has been recovered on top of the electrolyte along with coal not initially having an oxygen-controlled surface.

While the reagent for froth flotation of bituminous coal has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A bituminous coal floating reagent comprising:

a. liquid hydrocarbon having a paraffinic base for wetting bituminous coal in water, b. a reducing material effective in an amount sufficient to establish a reducing environment around said bituminous coal for breaking any oxygen control on the surface thereof and to form hydrogen sulfide in acid water, the reducing material being phosphorous pentasulfide and c. an activator material in an amount effective to provide a cation contained in the liquid hydrocarbon capable of establishing an electrostatic charge on said bituminous coal after any oxygen control on the surface has been broken.

2. A bituminous coal floating reagent comprising:

a. liquid hydrocarbon having a paraffinic base for wetting bituminous coal in water, b. a reducing material effective in an amount sufficient to establish a reducing environment around said bituminous coal for breaking any oxygen control on the surface thereof and to form hydrogen sulfide in acid water, c. an activator material in an amount effective to provide a cation contained in the liquid hydrocarbon capable of establishing an electrostatic charge on said bituminous coal after any oxygen control on the surface has been broken, and d. the liquid hydrocarbon being mineral oil, the reducing material being phospherous pentasulfide, and the activator material being a zinc thiophosphate compound made in situ.

3. A bituminous coal flotation reagent comprising:

(a) phosphorous pentasulfide in amounts sufficient to establish a reducing environment around bituminous coal disposed in a liquid medium, (b) carbon disulfide as an intermediate solvent for dissolving the phosphorous pentasulfide, (c) zinc ethylenebis(dithiocarbamate) dissolved in the intermediate solvent in an amount effective to provide a zinc cation and (d) a liquid hydrocarbon having a paraffinic base and being in an amount sufficient to contain the phosphorous pentasulfide and zinc ethylenebis(dithiocarbamate) in solution.

4. A reagent as defined in claim 3 wherein the liquid hydrocarbon is mineral oil.

* * * * *